United States Patent [19]

Uchiyama et al.

[11] Patent Number: 4,636,297

[45] Date of Patent: Jan. 13, 1987

[54] METHOD FOR PREVENTING COKING IN HYDROCARBON TREATMENT PROCESS

[75] Inventors: Hiroshi Uchiyama, Chiba; Yukinori Matsui, Yokkaichi, both of Japan

[73] Assignee: Hakuto Chemical Co., Ltd., Tokyo, Japan

[21] Appl. No.: 764,879

[22] Filed: Aug. 12, 1985

[30] Foreign Application Priority Data

Aug. 16, 1984 [JP] Japan ..... 59-169941
Jan. 10, 1985 [JP] Japan ..... 60-1428

[51] Int. Cl.[4] ..... C10G 9/16
[52] U.S. Cl. ..... 208/48 AA; 208/113; 208/132; 208/208 R; 208/134; 585/650
[58] Field of Search ..... 208/47, 48 AA

[56] References Cited

U.S. PATENT DOCUMENTS

| | | | |
|---|---|---|---|
| 3,024,277 | 3/1962 | Hotten | 208/48 AA |
| 3,380,909 | 4/1968 | Lee | 208/48 AA |
| 3,619,125 | 11/1971 | Porwancher et al. | 208/47 |
| 4,105,540 | 8/1978 | Weinland | 208/48 AA |

*Primary Examiner*—John Doll
*Assistant Examiner*—Lance Johnson
*Attorney, Agent, or Firm*—Frishauf, Holtz, Goodman & Woodward

[57] ABSTRACT

Specified sulfur compounds such as N,N-diethylthiourea, N,N-dibutylthiourea, tetramethylthiuram monosulfide, tetrabutylthiuram monosulfide, tetraethylthiuram disulfide, tetrabutylthiuram disulfide are supplied as a coking inhibitor for preventing coking in equipment used in hydrocarbon treatment processes wherein a hydrocarbon is treated at a temperature of from about 250° C. to 950° C. to produce petroleum products, petrochemical products and/or their intermediate products.

15 Claims, No Drawings

METHOD FOR PREVENTING COKING IN HYDROCARBON TREATMENT PROCESS

BACKGROUND OF THE INVENTION

1. Field of the Invention

This invention relates to a method for preventing coking in equipment used in hydrocarbon treatment processes wherein a hydrocarbon is treated at a temperature of from about 250° to about 950° C. to produce petroleum products, petrochemical products and/or their intermediate products. More particularly, the present invention relates to a method for preventing coking in equipment such as heat exchangers, heating furnaces, reactors, connecting pipes and the like wherein a hydrocarbon is subjected to a process for refining, separation, extraction, desulfurization, reforming, polymerization, thermal cracking, catalytic cracking, synthetic reaction or a combination of at least two of them at a temperature of from about 250° to about 950° C. to produce petroleum products, petrochemical products and/or their intermediate products, the method comprising supplying a coking inhibitor to said equipment to prevent coking in the equipment.

2. Description of Prior Art

In many hydrocarbon treatment processes employed in petroleum and petrochemical industries, a hydrocarbon feed is heated to high temperatures in equipment such as heat exchangers, heating furnaces, reactors, ethylene cracking furnaces and the like to achieve an intended purpose. It is known that, in such case, coke-like substances (coke-like fouling) accumulate in thick deposits inside the equipment, particularly at the high temperature portions of the equipment, causing various disadvantages such as reduction in heat conduction efficiency and hindrance of the material flow inside the equipment. In order to remove these disadvantages, operators of such equipment generally conduct decoking or cleaning for the fouled equipment at frequent intervals. This solution is very undesirable when viewed from the aspect of energy saving or process rationalization.

As examples of the hydrocarbon treatment process according to the present invention, mention can be made of an atmospheric distillation column, a vacuum distillation column, a hydrodesulfurization column, a visbreaker, a coker, an aromatic hydrocarbon extraction column, etc. In these processes, a hydrocarbon feed liable to cause polymerization and coking with relative ease is used and relatively high temperatures are further employed; therefore, the coking that occurs has been big problem and countermeasures for it have been sought.

Coking is basically brought about in the following manner. A heavy fraction in feed hydrocarbon or a heavy fraction produced by partial polymerization of feed hydrocarbon adheres to the inside walls of process equipment, is exposed to high temperatures for a long period of time and grows into a coke-like substance. As methods for suppressing the formation and accumulation of such a coke-like substance, there have been proposed, for example, a method of adding a phosphoric acid derivative (U.S. Pat. No. 4,105,540), and so forth. However, all of the hitherto proposed methods are far from satisfactory and further improvements are desired.

SUMMARY OF THE INVENTION

It is an object of the invention to provide a method for preventing coking in hydrocarbon treatment process equipment by using an excellent coking inhibitor for process equipment which exhibits an inhibitory action for coking even at high temperatures of from about 250° to about 950° C., is stable, is soluble in hydrocarbons and easy to handle, and is suited for use in a wide range of hydrocarbon treatment processes.

Other objects and advantages of the present invention may become apparent to those skilled in the art from the following description and disclosure.

DETAILED DESCRIPTION OF THE PREFERRED EMBODIMENT

According to the present invention, the coking that occurs in heat exchangers (e.g., about 250°-600° C.), heating furnaces (e.g., about 300°-650° C.), reactors (e.g., about 250°-560° C.), ethylene cracking furnaces (e.g., about 260°-927° C.), and the like, used in hydrocarbon treatment processes can be advantageously suppressed by adding to a feed hydrocarbon used in said processes 10 to 5,000 ppm, desirably 10 to 1,000 ppm, of a compound represented by the following general formula I and/or II:

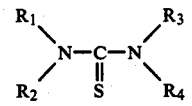

(I)

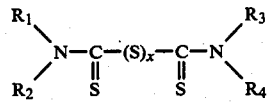

(II)

where $R_1$, $R_2$, $R_3$ and $R_4$ are each a hydrogen atom, an alkyl group of 1 to 30 carbon atoms, a cycloalkyl group, an aryl group, an alkanol group, an aralkyl group or an alkenyl group and can be the same or different, and x is an integer of 1 to 6. In the present invention, the compound represented by the general formula I and/or II is added to a feed hydrocarbon in an amount of 10 to 5,000 ppm, desirably 10 to 1,000 ppm. This is based on the idea that addition of too small an amount will not give sufficient effect and addition of an amount exceeding 5,000 ppm is not economical although sufficient effect would still be obtained. In the present invention, use of at least one compound represented by the formula I and/or II is proposed. However, mixed use of two or more of these compounds, as well as combined use of such a compound and another fouling inhibitor or coking inhibitor is possible. The present invention has no restriction on such mixed or combined use. As specific examples of the compounds represented by the formulas I and II of the present invention, there are mentioned N,N-diethylthiourea, N,N-dibutylthiourea, tetramethylthiuram monosulfide, tetrabutylthiuram monosulfide, tetraethylthiuram disulfide, tetrabutylthiuram disulfide, etc.

In the most usual way of carrying out the present invention method industrially, a compound represented by the formula I and/or II is dissolved in an organic solvent such as a hydrocarbon solvent, an oxygen-containing hydrocarbon solvent such as alcohol, a sulfur-containing solvent such as dimethyl sulfoxide or the like and then is injected into a feed hydrocarbon. In order to conduct suppresion of coking effectively, it is necessary that a coking inhibitor be uniformly mixed with the feed hydrocarbon between the time of inhibitor addition to feed hydrocarbon and the time of inhibitor arrival at heat exchanger, heating furnace, reactor, etc., by making the distance between the inhibitor addition point and the fouling sites as long as possible or by providing flections in the course of that distance.

Next, the present invention method will be explained specifically by way of Examples. However, the present invention is in no way restricted to these Examples which follow.

EXAMPLE 1

Into a test tube (material: SUS 316; inside diameter: 2.2 mm; length: 40 mm) heated at 450° C. was fed 1.5 ml/min of a mixture consisting of 90% by volume of kerosene and 10% by volume of toluene. A predetermined amount of the coking inhibitors shown in Table 1 are dissolved in said mixture of kerosene and toluene and are provided for tests. After the lapse of a predetermined time, the test tube was taken out. From the tube weights before and after the test, the amount of coke adhered to the tube was calculated. The same tests were repeated except that the coking inhibitors were absent. The results are given in the following Table 1.

TABLE 1

| Compounds used | Other test conditions: Addition amount (ppm) | Other test conditions: Test time (hr.) | Test results: Amount of coke adhered (mg) |
|---|---|---|---|
| Blank | — | 5 | 10 |
| | — | 10 | 15 |
| Examples | | | |
| N,N—diethylthiourea | 500 | 5 | 5 |
| " | 500 | 10 | 7 |
| " | 1,000 | 10 | 5 |
| Tetramethylthiuram disulfide | 500 | 10 | 6 |
| Tetramethylthiuram disulfide | 1,000 | 10 | 4 |
| Tetrabutylthiuram disulfide | 500 | 10 | 7 |
| Tetrabutylthiuram disulfide | 1,000 | 10 | 4 |
| Tetramethylthiuram monosulfide | 1,000 | 10 | 6 |

EXAMPLE 2

Tests were repeated in the same manner as in Example 1, except that a mixture consisting of 50% by volume of naphtha and 50% by volume of water was fed into the test tube heated at 650° C. and 850° C., and when blocking up of the test tube occurred due to the hard coking of the naphtha during the test, the tests were stopped to allow calculation of the amount of coke adhered to the tube. The results are given in the following Tables 2 and 3.

TABLE 2

| Tests at 650° C. | Other test conditions | | Test results | |
|---|---|---|---|---|
| Compounds used | Addition amount (ppm) | Test time (hr) | Amount of coke adhered (mg) | Amount of coke adhered per hr. (mg/hr) |
| Blank | — | 10.0 | 44.0 | 4.4 |
| Examples | | | | |
| N,N—diethylthiourea | 100 | 10.0 | 31.2 | 3.1 |
| " | 500 | 10.0 | 19.3 | 1.9 |

TABLE 2-continued

| Tests at 650° C. | Other test conditions | | Test results | |
|---|---|---|---|---|
| Compounds used | Addition amount (ppm) | Test time (hr) | Amount of coke adhered (mg) | Amount of coke adhered per hr. (mg/hr) |
| N,N—dibutylthiourea | 500 | 10.0 | 17.0 | 1.7 |
| Tetrabutylthiuram disulfide | 100 | 10.0 | 28.7 | 2.9 |
| Tetrabutylthiuram disulfide | 500 | 10.0 | 14.9 | 1.5 |
| Tetramethylthiuram monosulfide | 500 | 10.0 | 16.2 | 1.6 |
| Comp. Examples | | | | |
| Di(2-ethylhexyl) phosphate | 500 | 10.0 | 52.0 | 5.2 |
| Tris(2-ethylhexyl) phosphite | 500 | 10.0 | 49.5 | 5.0 |
| Hydrogen sulfide | 100 | 10.0 | 43.2 | 4.3 |

TABLE 3

| Tests at 850° C. | Other test conditions | | Test results | |
|---|---|---|---|---|
| Compounds used | Addition amount (ppm) | Test time (hr) | Amount of coke adhered (mg) | Amount of coke adhered per hr. (mg/hr) |
| Blank | — | 3.0 (blocking) | 126.5 | 42.2 |
| Examples | | | | |
| N,N—diethylthiourea | 100 | 4.5 (blocking) | 144.9 | 32.2 |
| " | 500 | 7.0 (blocking) | 140.0 | 20.0 |
| " | 1,000 | 10.0 (blocking) | 160.0 | 16.0 |
| N,N—dibutylthiourea | 500 | 6.5 (blocking) | 137.8 | 21.2 |
| " | 1,000 | 9.0 (blocking) | 157.5 | 17.5 |
| N,N—dilaurylthiourea | 100 | 4.5 (blocking) | 153.0 | 34.0 |
| " | 500 | 6.2 (blocking) | 147.6 | 23.8 |
| Tetrabutylthiuram disulfide | 100 | 5.0 (blocking) | 147.5 | 29.5 |
| Tetrabutylthiuram disulfide | 500 | 7.2 (blocking) | 159.1 | 22.1 |
| Tetrabutylthiuram disulfide | 1,000 | 10.0 | 180.0 | 18.0 |
| Tetraethylthiuram disulfide | 100 | 5.0 (blocking) | 155.0 | 31.0 |
| Tetraethylthiuram disulfide | 500 | 7.2 (blocking) | 174.2 | 24.2 |
| Tetramethylthiuram disulfide | 500 | 7.0 (blocking) | 164.5 | 23.5 |
| Tetramethylthiuram monosulfide | 500 | 6.5 (blocking) | 158.0 | 24.3 |
| Composition of tetrabutylthiuram disulfide + di(2-ethylhexyl)phosphate | 100 + 20 | 7.0 (blocking) | 155.2 | 22.2 |
| Composition of tetrabutylthiuram disulfide + tris(2-ethylhexyl)phosphite | 500 + 50 | 8.0 (blocking) | 161.6 | 20.2 |
| Comp. Examples | | | | |
| Di(2-ethylhexyl) phosphate | 500 | 1.5 (blocking) | 78.0 | 52.0 |
| Di(2-ethylhexyl) phosphate | 1,000 | 1.0 (blocking) | 88.0 | 88.0 |
| Tris(2-ethylhexyl) phosphite | 1,000 | 1.1 (blocking) | 80.0 | 72.7 |
| Hydrogen sulfide | 100 | 3.0 | 118.5 | 39.5 |

TABLE 3-continued

| | Tests at 850° C. | | | |
|---|---|---|---|---|
| | Other test conditions | | Test results | |
| Compounds used | Addition amount (ppm) | Test time (hr) | Amount of coke adhered (mg) | Amount of coke adhered per hr. (mg/hr) |
| | | (blocking) | | |

According to the present invention, coking in hydrocarbon treatment process equipment is suppressed substantially; reduction in heat conduction and heat efficiency as well as hindrance of fluid transfer is alleviated; and the need for frequent suspension of operation and cleaning is reduced. Thus, the present invention has significant effects on energy saving, production rationalization and facility maintenance.

What is claimed is:

1. A method for suppressing coking in equipment used in a hydrocarbon treatment process wherein a hydrocarbon is treated at a temperature of from about 250° to about 950° C. to produce at least one of petroleum products, petrochemical products and their intermediate products, the method comprising supplying to at least a portion of said equipment susceptible to coking, an effective amount of a coking inhibitor containing, as an active component, at least one compound selected from the group consisting of N,N-diethylthiourea, N,N-dibutylthiourea, N,N-dilaurylthiourea, tetramethylthiuram monosulfide, tetramethylthiuram disulfide, tetraethylthiuram disulfide, and tetrabutylthiuram disulfide.

2. The method according to claim 1, wherein the hydrocarbon treatment process is a process for hydrocarbon refining, separation, extraction, desulfurization, reforming, polymerization, thermal cracking, catalytic cracking, synthetic reaction or a combination of at least two of them.

3. The method according to claim 1, wherein said equipment comprises ethylene cracking furnaces using petroleum feedstocks.

4. The method according to claim 1, wherein said equipment comprises ethylene cracking furnaces and subsequent heat-exchangers used for cooling.

5. The method according to claim 1, wherein the coking inhibitor is preliminarily added to and mixed with a hydrocarbon feed.

6. The method according to claim 5, wherein the coking inhibitor is added to a hydrocarbon feed in an amount of 10 to 5,000 ppm based on the amount of hydrocarbon feed.

7. The method according to claim 5, wherein the coking inhibitor is preliminarily dissolved in an organic solvent and then is added to a hydrocarbon feed.

8. The method according to claim 7, wherein the coking inhibitor is added to a hydrocarbon feed in an amount of 10 to 1,000 ppm based on the amount of hydrocarbon feed.

9. The method according to claim 8, wherein said compound is N,N-diethylthiourea.

10. The method according to claim 8, wherein said compound is N,N-dibutylthiourea.

11. The method according to claim 8, wherein said compound is N,N-dilaurylthiourea.

12. The method according to claim 8, wherein said compound is tetramethylthiuram monosulfide.

13. The method according to claim 8, wherein said compound is tetramethylthiuram disulfide.

14. The method according to claim 8, wherein said compound is tetraethylthiuram disulfide.

15. The method according to claim 8, wherein said compound is tetrabutylthiuram disulfide.

* * * * *